US009222485B2

(12) United States Patent
Brown et al.

(10) Patent No.: US 9,222,485 B2
(45) Date of Patent: Dec. 29, 2015

(54) CENTRIFUGAL COMPRESSOR DIFFUSER

(76) Inventors: Paul C. Brown, Buffalo, NY (US); Mikhail Grigoriev, East Amherst, NY (US); Chester V. Swiatek, Williamsville, NY (US)

( * ) Notice: Subject to any disclaimer, the term of this patent is extended or adjusted under 35 U.S.C. 154(b) by 906 days.

(21) Appl. No.: 13/386,025

(22) PCT Filed: Jul. 19, 2010

(86) PCT No.: PCT/US2010/042474

§ 371 (c)(1),
(2), (4) Date: Jan. 19, 2012

(87) PCT Pub. No.: WO2011/011335

PCT Pub. Date: Jan. 27, 2011

(65) Prior Publication Data

US 2012/0121402 A1 May 17, 2012

Related U.S. Application Data

(60) Provisional application No. 61/226,732, filed on Jul. 19, 2009.

(51) Int. Cl.
*F04D 29/44* (2006.01)

(52) U.S. Cl.
CPC ..... *F04D 29/444* (2013.01); *F04D 29/448* (2013.01)

(58) Field of Classification Search
CPC ... F04D 29/441; F04D 29/444; F04D 29/448; F04D 29/661; F04D 29/667; F04D 27/02
USPC ..... 415/191, 194, 199.1, 199.4, 208.1, 415/208.2, 211.1; 416/DIG. 5
See application file for complete search history.

(56) References Cited

U.S. PATENT DOCUMENTS

| | | | |
|---|---|---|---|
| 2,372,880 | A | 1/1944 | Browne |
| 3,006,603 | A | 10/1961 | Caruso et al. |
| 3,997,281 | A | 12/1976 | Atkinson |
| 4,054,398 | A | 10/1977 | Penny |
| 4,790,720 | A | 12/1988 | Rodgers |

(Continued)

FOREIGN PATENT DOCUMENTS

| | | | |
|---|---|---|---|
| CN | 85202558 | U | 8/1986 |
| CN | 86102777 | A | 11/1987 |

(Continued)

OTHER PUBLICATIONS

PCT Search Report and Written Opinion for PCT/US2010/042474, mailed on Nov. 3, 2010.

(Continued)

*Primary Examiner* — Edward Look
*Assistant Examiner* — Danielle M Christensen
(74) *Attorney, Agent, or Firm* — Taft, Stettinius & Hollister LLP

(57) ABSTRACT

A system, in certain embodiments, includes a centrifugal compressor diffuser vane including a leading edge, a trailing edge, and a constant thickness section extending between the leading edge and the trailing edge. A radius of curvature of the leading edge and a radius of curvature of the trailing edge vary along a span of the vane. A ratio of a length of the constant thickness section to a chord length of the vane is at least approximately 50%, and the ratio is substantially constant along the span of the vane.

29 Claims, 6 Drawing Sheets

(56) References Cited

U.S. PATENT DOCUMENTS

| | | | | |
|---|---|---|---|---|
| 4,877,370 | A | 10/1989 | Nakagawa et al. | |
| 5,310,309 | A | 5/1994 | Terasaki et al. | |
| 5,316,441 | A * | 5/1994 | Osborne | 415/208.4 |
| 5,452,986 | A | 9/1995 | Osborne et al. | |
| 5,529,457 | A | 6/1996 | Terasaki et al. | |
| 7,101,151 | B2 | 9/2006 | Loringer et al. | |
| 7,448,852 | B2 | 11/2008 | Abdelwahab et al. | |
| 2004/0071549 | A1 | 4/2004 | Kim et al. | |
| 2005/0005606 | A1 | 1/2005 | Vrbas et al. | |
| 2005/0232762 | A1 | 10/2005 | Smoke et al. | |
| 2008/0038114 | A1 | 2/2008 | Abdelwahab et al. | |

FOREIGN PATENT DOCUMENTS

| | | | |
|---|---|---|---|
| DE | 3424925 | C1 | 10/1985 |
| DE | 3926152 | A1 | 1/1991 |
| DE | 4438611 | A1 | 5/1996 |
| EP | 0538753 | | 4/1993 |
| EP | 1832754 | | 9/2007 |
| EP | 1873402 | A1 | 1/2008 |
| GB | 138404 | A | 2/1920 |
| GB | 985743 | A | 3/1965 |
| JP | 5044693 | A | 2/1993 |
| WO | 2008023034 | A1 | 2/2008 |
| WO | 2009007404 | A1 | 1/2009 |

OTHER PUBLICATIONS

PCT International Search Report and Written Opinion for PCT Application No. PCT/US2010/058429 dated Apr. 6, 2011.

PCT International Preliminary Report on Patentability for PCT Application No. PCT/US2010/058429 dated Aug. 7, 2012.

Teipel, I. et al.; Three-Dimensional Flowfield Calculation of High-Loaded Centrifugal Compressor Diffusers; Journal of Turbomachinery; Jan. 1987; pp. 20-26; vol. 109.

Orth, U. et al.; Improved Compressor Exit Diffuser for an Industrial Gas Turbine; Journal of Turbomachinery; Jan. 2002; pp. 19-26; vol. 124.

Bammert, K.; On the Influence of the Diffuser Inlet Shape on the Performance of A Centrifugal Compressor Stage; The American Society of Mechanical Engineers; University of Hannover; Hannover, West Germany; 1983; p. 1-8.

Japikse, David; Turbomachinery Diffuser Design Technology; The Design Technology Series (DTS-1); Concepts ETI Inc.; Norwich, Vermont; 1984.

Japikse, David; Centrifugal Compressor Design and Performance; Diffusers in Centrifugal Compressor Design; Concepts ETI Inc.; Wilder, Vermont; 1996.

Pampreen, Ronald C.; Compressor Surge and Stall; Concepts ETI Inc.; Norwich, Vermont; 1993.

Tang, Jin; Computational Analysis and Optimization of Real Gas Flow in Small Centrifugal Compressors; Lappeenranta; 2006.

PCT International Search Report and Written Opinion for PCT/US2010/58439, dated May 25, 2011.

Notification of the First Office Action; The State Intellectual Property Office of P.R. China; Application No. 201080041658.7; dated Mar. 3, 2014; 15 pages.

* cited by examiner

CENTRIFUGAL COMPRESSOR DIFFUSER

CROSS REFERENCE TO RELATED APPLICATION

This application claims priority to U.S. Provisional Patent Application No. 61/226,732, entitled "Centrifugal Compressor Diffuser", filed on Jul. 19, 2009, and which is herein incorporated by reference in its entirety.

BACKGROUND

This section is intended to introduce the reader to various aspects of art that may be related to various aspects of the present invention, which are described and/or claimed below. This discussion is believed to be helpful in providing the reader with background information to facilitate a better understanding of the various aspects of the present invention. Accordingly, it should be understood that these statements are to be read in this light, and not as admissions of prior art.

Centrifugal compressors may be employed to provide a pressurized flow of fluid for various applications. Such compressors typically include an impeller that is driven to rotate by an electric motor, an internal combustion engine, or another drive unit configured to provide a rotational output. As the impeller rotates, fluid entering in an axial direction is accelerated and expelled in a circumferential and a radial direction. The high-velocity fluid then enters a diffuser which converts the velocity head into a pressure head (i.e., decreases flow velocity and increases flow pressure). In this manner, the centrifugal compressor produces a high-pressure fluid output. Unfortunately, there is a tradeoff between performance and efficiency in existing diffusers.

BRIEF DESCRIPTION OF THE DRAWINGS

Various features, aspects, and advantages of the present invention will become better understood when the following detailed description is read with reference to the accompanying figures in which like characters represent like parts throughout the figures, wherein.

DETAILED DESCRIPTION OF SPECIFIC EMBODIMENTS

One or more specific embodiments of the present invention will be described below. These described embodiments are only exemplary of the present invention. Additionally, in an effort to provide a concise description of these exemplary embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

In certain configurations, a diffuser includes a series of vanes configured to enhance diffuser efficiency. Certain diffusers may include three-dimensional airfoil-type vanes or two-dimensional cascade-type vanes. The airfoil-type vanes provide a greater maximum efficiency, but decreased performance within surge flow and choked flow regimes. In contrast, cascade-type vanes provide enhanced surge flow and choked flow performance, but result in decreased maximum efficiency compared to airfoil-type vanes.

Embodiments of the present disclosure may increase diffuser efficiency and reduce surge flow and choked flow losses by employing three-dimensional non-airfoil diffuser vanes particularly configured to match flow variations from an impeller. In certain embodiments, each diffuser vane includes a tapered leading edge, a tapered trailing edge and a constant thickness section extending between the leading edge and the trailing edge. A length of the constant thickness section may be greater than approximately 50% of a chord length of the diffuser vane. A radius of curvature of the leading edge, a radius of curvature of the trailing edge, and the chord length may be configured to vary along a span of the diffuser vane. In this manner, the diffuser vane may be particularly adjusted to compensate for axial flow variations from the impeller. In further configurations, a camber angle of the diffuser vane may also be configured to vary along the span. Other embodiments may enable a circumferential position of the leading edge and/or the trailing edge of the diffuser vane to vary along the span of the vane. Such adjustment may facilitate a non-airfoil vane configuration that is adjusted to coincide with the flow properties of a particular impeller, thereby increasing efficiency and decreasing surge flow and choked flow losses.

Figure 1:
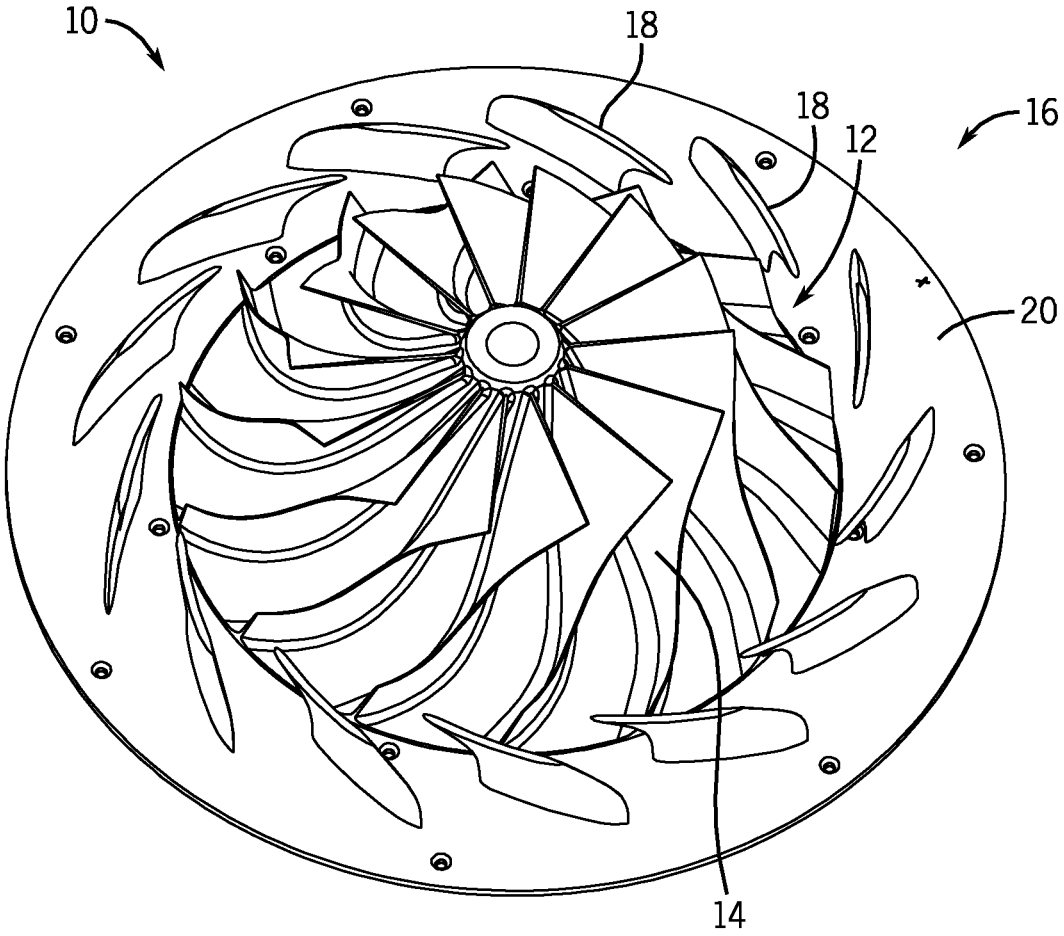
FIG. 1 is a perspective view of centrifugal compressor components including diffuser vanes having a constant thickness section and specifically contoured to match the flow characteristics of an impeller in accordance with certain embodiments of the present technique.

FIG. 1 is a perspective view of centrifugal compressor 10 components configured to output a pressurized fluid flow. Specifically, the centrifugal compressor 10 includes an impeller 12 having multiple blades 14. As the impeller 12 is driven to rotate by an external source (e.g., electric motor, internal combustion engine, etc.), compressible fluid entering the blades 14 is accelerated toward a diffuser 16 disposed about the impeller 12. In certain embodiments, a shroud (not shown) is positioned directly adjacent to the diffuser 16, and serves to direct fluid flow from the impeller 12 to the diffuser 16. The diffuser 16 is configured to convert the high-velocity fluid flow from the impeller 12 into a high pressure flow (i.e., convert the dynamic head to pressure head).

In the present embodiment, the diffuser 16 includes diffuser vanes 18 coupled to a hub 20 in an annular configuration. The vanes 18 are configured to increase diffuser efficiency. As discussed in detail below, each vane 18 includes a leading edge section, a trailing edge section and a constant thickness section extending between the leading edge section and the trailing edge section, thereby forming a non-airfoil vane 18. Properties of the vane 18 are configured to establish a three-dimensional arrangement that particularly matches the fluid flow expelled from the impeller 12. By contouring the three-dimensional non-airfoil vane 18 to coincide with impeller exit flow, efficiency of the diffuser 16 may be increased compared to two-dimensional cascade diffusers. In addition, surge flow and choked flow losses may be reduced compared to three-dimensional airfoil-type diffusers.

Figure 2:
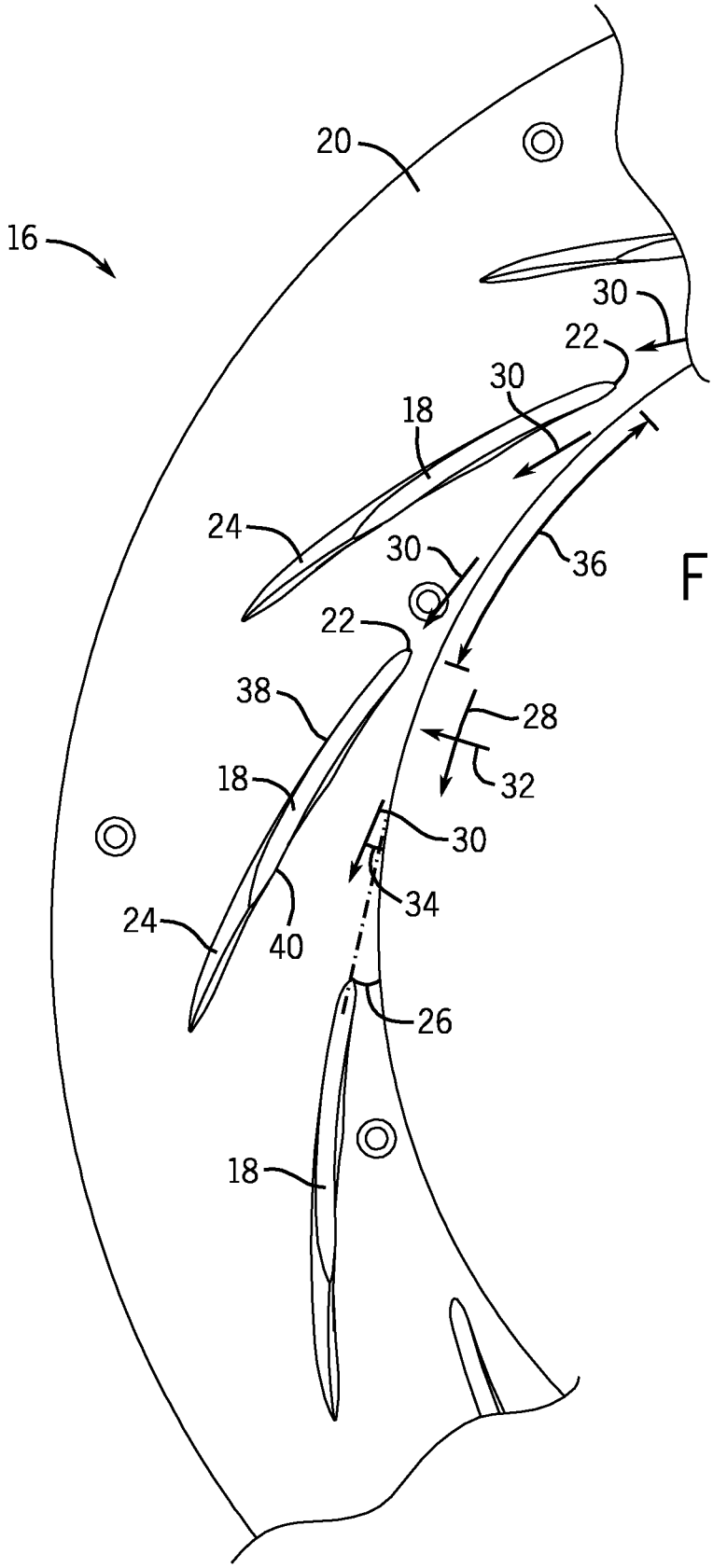
FIG. 2 is a partial axial view of a centrifugal compressor diffuser, as shown in FIG. 1, depicting fluid flow through the diffuser in accordance with certain embodiments of the present technique.

FIG. 2 is a partial axial view of the diffuser 16, showing fluid flow expelled from the impeller 12. As illustrated, each vane 18 includes a leading edge 22 and a trailing edge 24. As discussed in detail below, fluid flow from the impeller 22 flows from the leading edge 22 to the trailing edge 24, thereby converting dynamic pressure (i.e., flow velocity) into static pressure (i.e., pressurized fluid). In the present embodiment, the leading edge 22 of each vane 18 is oriented at an angle 26 with respect to a circumferential axis 28 of the hub 20. The circumferential axis 28 follows the curvature of the annual hub 20. Therefore, a 0 degree angle 26 would result in a leading edge 22 oriented substantially tangent to the curvature of the hub 20. In certain embodiments, the angle 26 may be approximately between 0 to 60, 5 to 55, 10 to 50, 15 to 45, 15 to 40, 15 to 35, or about 10 to 30 degrees. In the present embodiment, the angle 26 of each vane 18 may vary between approximately 17 to 24 degrees. However, alternative configurations may employ vanes 18 having different orientations relative to the circumferential axis 28.

As illustrated, fluid flow 30 exits the impeller in both the circumferential direction 28 and a radial direction 32. Specifically, the fluid flow 30 is oriented at an angle 34 with respect to the circumferential axis 28. As will be appreciated, the angle 34 may vary based on impeller configuration, impeller rotation speed, and/or flow rate through the compressor 10, among other factors. In the present configuration, the angle 26 of the vanes 18 is particularly configured to match the direction of fluid flow 30 from the impeller 12. As will be appreciated, a difference between the leading edge angle 26 and the fluid flow angle 34 may be defined as an incidence angle. The vanes 18 of the present embodiment are configured to substantially reduce the incidence angle, thereby increasing the efficiency of the centrifugal compressor 10.

As previously discussed, the vanes 18 are disposed about the hub 20 in a substantially annular arrangement. A spacing 36 between vanes 18 along the circumferential direction 28 may be configured to provide efficient conversion of the velocity head to pressure head. In the present configuration, the spacing 36 between vanes 18 is substantially equal. However, alternative embodiments may employ uneven blade spacing.

Each vane 18 includes a pressure surface 38 and a suction surface 40. As will be appreciated, as the fluid flows from the leading edge 22 to the trailing edge 24, a high pressure region is induced adjacent to the pressure surface 38 and a lower pressure region is induced adjacent to the suction surface 40. These pressure regions affect the flow field from the impeller 12, thereby increasing flow stability and efficiency compared to vaneless diffusers. In the present embodiment, each three-dimensional non-airfoil vane 18 is particularly configured to match the flow properties of the impeller 12, thereby providing increased efficiency and decreased losses within the surge flow and choked flow regimes.

Figure 3:
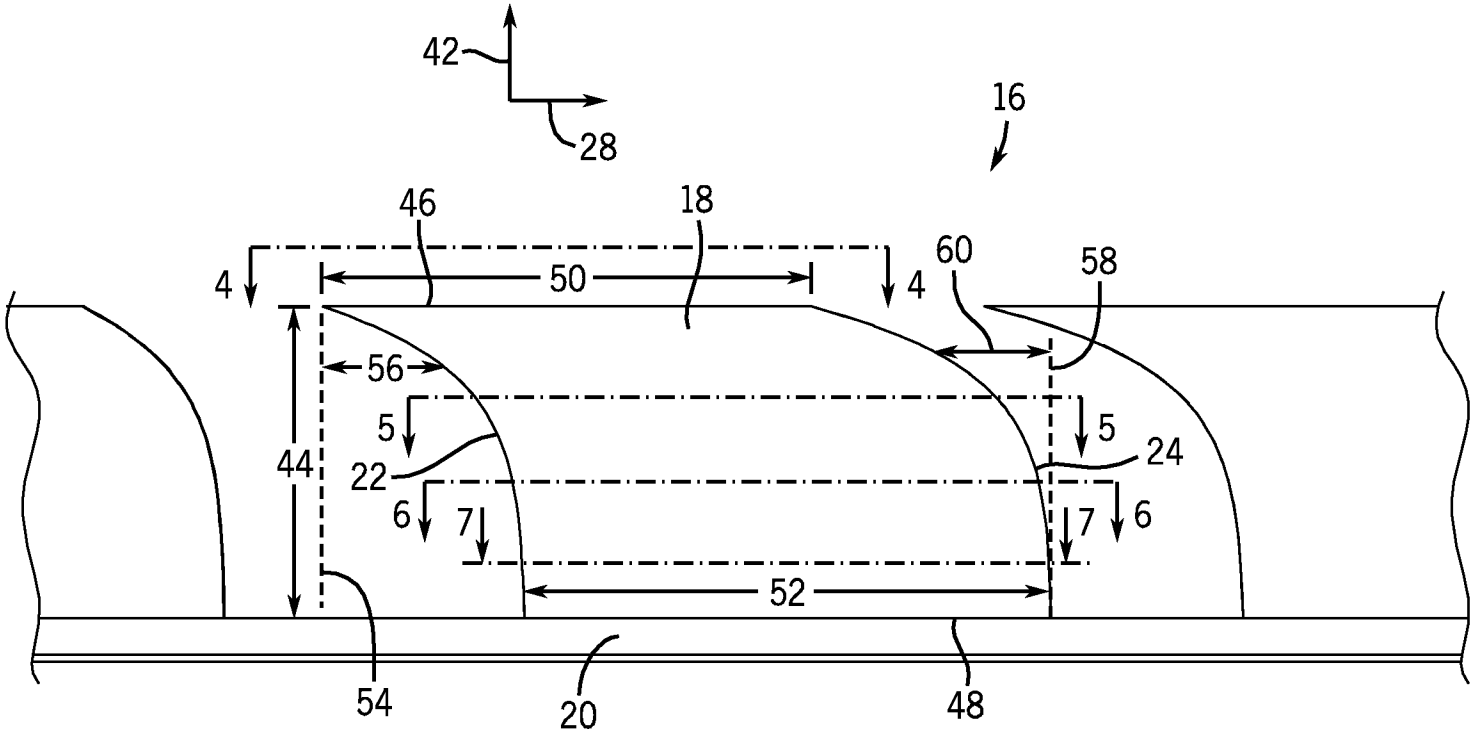
FIG. 3 is a meridional view of the centrifugal compressor diffuser, as shown in FIG. 1, depicting a diffuser vane profile in accordance with certain embodiments of the present technique.

FIG. 3 is a meridional view of the centrifugal compressor diffuser 16, showing a diffuser vane profile. Each vane 18 extends along an axial direction 42 between the hub 20 and a shroud (not shown), forming a span 44. Specifically, the span 44 is defined by a vane tip 46 on the shroud side and a vane root 48 on the hub side. As discussed in detail below, a chord length is configured to vary along the span 44 of the vane 18. Chord length is the distance between the leading edge 22 and the trailing edge 24 at a particular axial position along the vane 18. For example, a chord length 50 of the vane tip 46 may vary from a chord length 52 of the vane root 48. A chord length for an axial position (i.e., position along the axial direction 42) of the vane 18 may be selected based on fluid flow characteristics at that particular axial location. For example, computer modeling may determine that fluid velocity from the impeller 12 varies in the axial direction 42. Therefore, the chord length for each axial position may be particularly selected to correspond to the incident fluid velocity. In this manner, efficiency of the vane 18 may be increased compared to configurations in which the chord length remains substantially constant along the span 44 of the vane 18.

In addition, a circumferential position (i.e., position along the circumferential direction 28) of the leading edge 22 and/or trailing edge 24 may be configured to vary along the span 44 of the vane 18. As illustrated, a reference line 54 extends from the leading edge 22 of the vane tip 46 to the hub 20 along the axial direction 42. The circumferential position of the leading edge 22 along the span 44 is offset from the reference line 54 by a variable distance 56. In other words, the leading edge 22 is variable rather than constant in the circumferential direction 28. This configuration establishes a variable distance between the impeller 12 and the leading edge 22 of the vane 18 along the span 44. For example, based on computer simulation of fluid flow from the impeller 12, a particular distance 56 may be selected for each axial position along the span 44. In this manner, efficiency of the vane 18 may be increased compared to configurations employing a constant distance 56. In the present embodiment, the distance 56 increases as distance from the vane tip 46 increases. Alternative embodiments may employ other leading edge profiles, including arrangements in which the leading edge 22 extends past the reference line 54 along a direction toward the impeller 12.

Similarly, a circumferential position of the trailing edge 24 may be configured to vary along the span 44 of the vane 18. As illustrated, a reference line 58 extends from the trailing edge 24 of the vane root 48 away from the hub 20 along the axial direction 42. The circumferential position of the trailing edge 24 along the span 44 is offset from the reference line 58 by a variable distance 60. In other words, the trailing edge 24 is variable rather than constant in the circumferential direction 28. This configuration establishes a variable distance between the impeller 12 and the trailing edge 24 of the vane 18 along the span 44. For example, based on computer simulation of fluid flow from the impeller 12, a particular distance 60 may be selected for each axial position along the span 44. In this manner, efficiency of the vane 18 may be increased compared to configurations employing a constant distance 60. In the present embodiment, the distance 60 increases as distance from the vane root 48 increases. Alternative embodiments may employ other trailing edge profiles, including arrangements in which the trailing edge 24 extends past the reference line 58 along a direction away from the impeller 12. In further embodiments, a radial position of the leading edge 22 and/or a radial position of the trailing edge 24 may vary along the span 44 of the diffuser vane 18.

Figure 4:
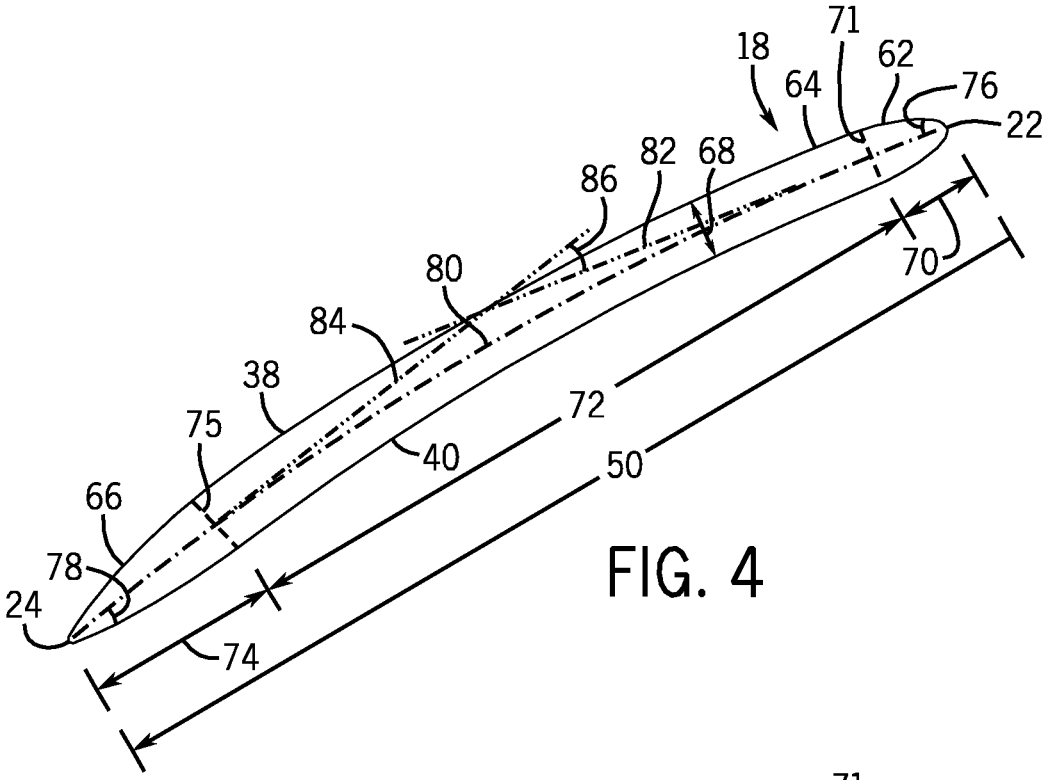
FIG. 4 is a top view of a diffuser vane profile, taken along line 4-4 of FIG. 3, in accordance with certain embodiments of the present technique.

FIG. 4 is a top view of a diffuser vane profile, taken along line 4-4 of FIG. 3. As illustrated, the vane 18 includes a tapered leading edge section 62, a constant thickness section 64 and a tapered trailing edge section 66. A thickness 68 of the constant thickness section 64 is substantially constant between the leading edge section 62 and the trailing edge section 66. Due to the constant thickness section 64, the profile of the vane 18 is inconsistent with a traditional airfoil. In other words, the vane 18 may not be considered an airfoil-type diffuser vane. However, similar to an airfoil-type diffuser vane, parameters of the vane 18 may be particularly configured to coincide with three-dimensional fluid flow from a particular impeller 12, thereby efficiently converting fluid velocity into fluid pressure.

For example, as previously discussed, the chord length for an axial position (i.e., position along the axial direction 42) of the vane 18 may be selected based on the flow properties at that axial location. As illustrated, the chord length 50 of the vane tip 46 may be configured based on the flow from the impeller 12 at the tip 46 of the vane 18. Similarly, a length 70 of the tapered leading edge section 62 may be selected based on the flow properties at the corresponding axial location. As illustrated, the tapered leading edge section 62 establishes a converging geometry between the constant thickness section 64 and the leading edge 22. As will be appreciated, for a given thickness 68 of a base 71 of the tapered leading edge section 62, the length 70 may define a slope between the leading edge 22 and the constant thickness section 64. For example, a longer leading edge section 62 may provide a more gradual transition from the leading edge 22 to the constant thickness section 64, while a shorter section 62 may provide a more abrupt transition.

In addition, a length 72 of the constant thickness section 64 and a length 74 of the tapered trailing edge section 66 may be selected based on flow properties at a particular axial position. Similar to the leading edge section 62, the length 74 of the trailing edge section 66 may define a slope between the trailing edge 24 and a base 75. In other words, adjusting the length 74 of the trailing edge section 66 may provide desired flow properties around the trailing edge 24. As illustrated, the tapered trailing edge section 66 establishes a converging geometry between the constant thickness section 64 and the trailing edge 24. The length 72 of the constant thickness section 64 may result from selecting a desired chord length 50, a desired leading edge section length 70 and a desired trailing edge section length 74. Specifically, the remainder of the chord length 50 after the lengths 70 and 74 have been selected defines the length 72 of the constant thickness section 64. In certain configurations, the length 72 of the constant thickness section 64 may be greater than approximately 50%, 55%, 60%, 65%, 70%, 75%, or more of the chord length 50. As discussed in detail below, a ratio between the length 72 of the constant thickness section 64 and the chord length 50 may be substantially equal for each cross-sectional profile throughout the span 44.

Furthermore, the leading edge 22 and/or the trailing edge 24 may include a curved profile at the tip of the tapered leading edge section 62 and/or the tapered trailing edge section 66. Specifically, a tip of the leading edge 22 may include a curved profile having a radius of curvature 76 configured to direct fluid flow around the leading edge 22. As will be appreciated, the radius of curvature 76 may affect the slope of the tapered leading edge section 62. For example, for a given length 70, a larger radius of curvature 76 may establish a smaller slope between the leading edge 22 and the base 71, while a smaller radius of curvature 76 may establish a larger slope. Similarly, a radius of curvature 78 of a tip of the trailing edge 24 may be selected based on computed flow properties at the trailing edge 24. In certain configurations, the radius of curvature 76 of the leading edge 22 may be larger than the radius of curvature 78 of the trailing edge 24. Consequently, the length 74 of the tapered trailing edge section 66 may be larger than the length 70 of the tapered leading edge section 62.

Another vane property that may affect fluid flow through the diffuser 16 is the camber of the vane 18. As illustrated, a camber line 80 extends from the leading edge 22 to the trailing edge 24 and defines the center of the vane profile (i.e., the center line between the pressure surface 38 and the suction surface 40). The camber line 80 illustrates the curved profile of the vane 18. Specifically, a leading edge camber tangent line 82 extends from the leading edge 22 and is tangent to the camber line 80 at the leading edge 22. Similarly, a trailing edge camber tangent line 84 extends from the trailing edge 24 and is tangent to the camber line 80 at the trailing edge 24. A camber angle 86 is formed at the intersection between the tangent line 82 and tangent line 84. As illustrated, the larger the curvature of the vane 18, the larger the camber angle 86. Therefore, the camber angle 86 provides an effective measurement of the curvature or camber of the vane 18. The camber angle 86 may be selected to provide an efficient conversion from dynamic head to pressure head based on flow properties from the impeller 12. For example, the camber angle 86 may be greater than approximately 0, 5, 10, 15, 20, 25, 30, or more degrees.

The camber angle 86, the radius of curvature 76 of the leading edge 22, the radius of curvature 78 of the trailing edge 24, the length 70 of the tapered leading edge section 62, the length 72 of the constant thickness section 64, the length 74 of the tapered trailing edge section 66, and/or the chord length 50 may vary along the span 44 of the vane 18. Specifically, each of the above parameters may be particularly selected for each axial cross section based on computed flow properties at the corresponding axial location. In this manner, a three-dimensional vane 18 (i.e., a vane 18 having variable cross section geometry) may be constructed that provides increased efficiency compared to a two-dimensional vane (i.e., a vane having a constant cross section geometry). In addition, as discussed in detail below, the diffuser 16 employing such vanes 18 may maintain efficiency throughout a wide range of operating flow rates.

Figure 5:
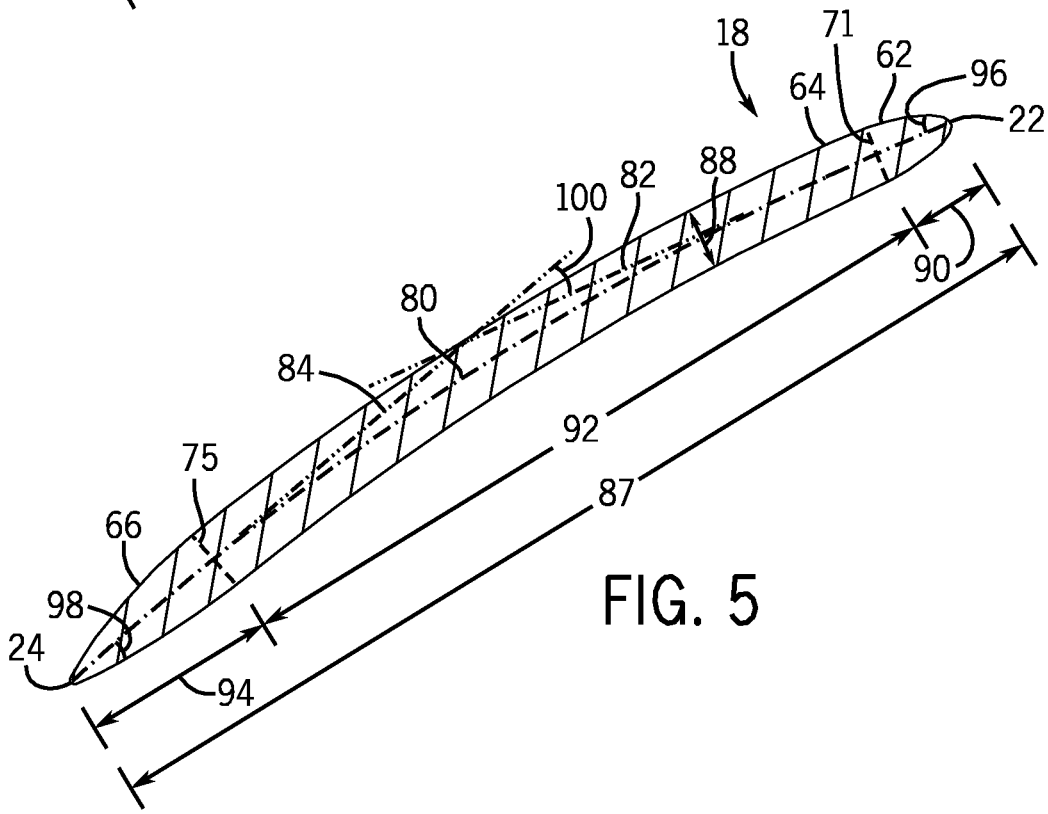
FIG. 5 is a cross section of a diffuser vane, taken along line 5-5 of FIG. 3, in accordance with certain embodiments of the present technique.

FIG. 5 is a cross section of a diffuser vane 18, taken along line 5-5 of FIG. 3. Similar to the previously discussed profile, the present vane section includes a tapered leading edge section 62, a constant thickness section 64, and a tapered trailing edge section 66. However, the configuration of these sections has been altered to coincide with the flow properties at the axial location corresponding to the present section. For example, the chord length 87 of the present section may vary from the chord length 50 of the vane tip 46. Similarly, a thickness 88 of the constant thickness section 64 may differ from the thickness 68 of the section of FIG. 4. Furthermore, a length 90 of the tapered leading edge section 62, a length 92 of the constant thickness section 64 and/or a length 94 of the tapered trailing edge section 66 may vary based on flow properties at the present axial location. However, a ratio of the length 92 of the constant thickness section 64 to the chord length 87 may be substantially equal to a ratio of the length 72 to the chord length 50. In other words, the constant thickness section length to chord length ratio may remain substantially constant throughout the span 44 of the vane 18.

Similarly, a radius of curvature 96 of the leading edge 22, a radius of curvature 98 of the trailing edge 24, and/or the camber angle 100 may vary between the illustrated section and the section shown in FIG. 4. For example, the radius of curvature 96 of the leading edge 22 may be particularly selected to reduce the incidence angle between the fluid flow from the impeller 12 and the leading edge 22. As previously discussed, the angle of the fluid flow from the impeller 12 may vary along the axial direction 42. Because the present embodiment facilitates selection of a radius of curvature 96 at each axial position (i.e., position along the axial direction 42), the incidence angle may be substantially reduced along the span 44 of the vane 18, thereby increasing the efficiency of the vane 18 compared to configurations in which the radius of curvature 96 of the leading edge 22 remains substantially constant throughout the span 44. In addition, because the velocity of the fluid flow from the impeller 12 may vary in the axial direction 42, adjusting the radii of curvature 96 and 98, chord length 87, chamber angle 100, or other parameters for each axial section of the vane 18 may facilitate increased efficiency of the entire diffuser 16.

Figure 6:
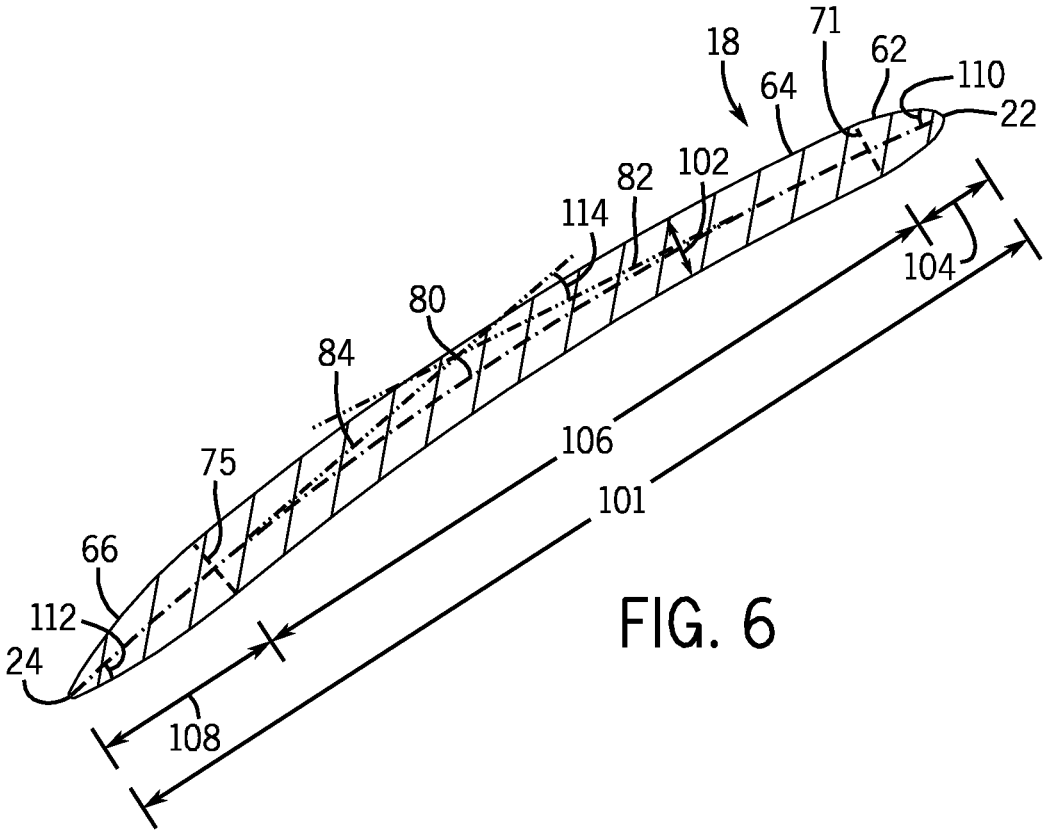
FIG. 6 is a cross section of a diffuser vane, taken along line 6-6 of FIG. 3, in accordance with certain embodiments of the present technique.

FIG. 6 is a cross section of a diffuser vane 18, taken along line 6-6 of FIG. 3. Similar to the section of FIG. 5, the profile of the present section is configured to match the flow properties at the corresponding axial location. Specifically, the present section includes a chord length 101, a thickness 102 of the constant thickness section 64, a length 104 of the leading edge section 62, a length 106 of the constant thickness section 64, and a length 108 of the trailing edge section 66 that may vary from the corresponding parameters of the section shown in FIG. 4 and/or FIG. 5. In addition, a radius of curvature 110 of the leading edge 22, a radius of curvature 112 of the trailing edge 24, and a camber angle 114 may also be particularly configured for the flow properties (e.g., velocity, incidence angle, etc.) at the present axial location.

Figure 7:
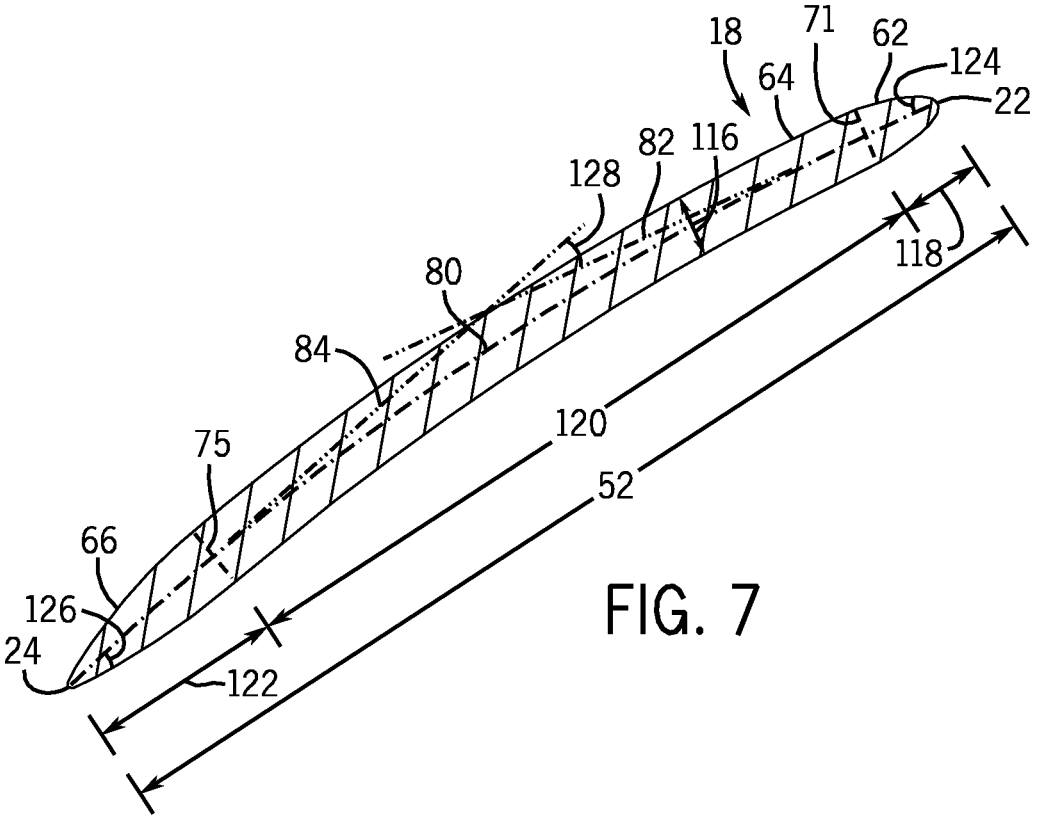
FIG. 7 is a cross section of a diffuser vane, taken along line 7-7 of FIG. 3, in accordance with certain embodiments of the present technique.

FIG. 7 is a cross section of a diffuser vane 18, taken along line 7-7 of FIG. 3. Similar to the section of FIG. 6, the profile of the present section is configured to match the flow properties at the corresponding axial location. Specifically, the present section includes a chord length 52, a thickness 116 of the constant thickness section 64, a length 118 of the leading edge section 62, a length 120 of the constant thickness section 64, and a length 122 of the trailing edge section 66 that may vary from the corresponding parameters of the section shown in FIG. 4, FIG. 5 and/or FIG. 6. In addition, a radius of curvature 124 of the leading edge 22, a radius of curvature 126 of the trailing edge 24, and a camber angle 128 may also be particularly configured for the flow properties (e.g., velocity, incidence angle, etc.) at the present axial location.

In certain embodiments, the profile of each axial section may be selected based on a two-dimensional transformation of an axial flat plate to a radial flow configuration. Such a technique may involve performing a conformal transformation of a rectilinear flat plate profile in a rectangular coordinate system into a radial plane of a curvilinear coordinate system, while assuming that the flow is uniform and aligned within the original rectangular coordinate system. In the transformed coordinate system, the flow represents a logarithmic spiral vortex. If the leading edge 22 and trailing edge 24 of the diffuser vane 18 are situated on the same logarithmic spiral curve, the diffuser vane 18 performs no turning of the flow. The desired turning of the flow may be controlled by selecting a suitable camber angle. The initial assumption of flow uniformity in the rectangular coordinate system may be modified to involve an actual non-uniform flow field emanating from the impeller 12, thereby improving accuracy of the calculations. Using this technique, a radius of curvature of the leading edge, a radius of curvature of the trailing edge, and/or the camber angle, among other parameters, may be selected, thereby increasing efficiency of the vane 18.

Figure 8:
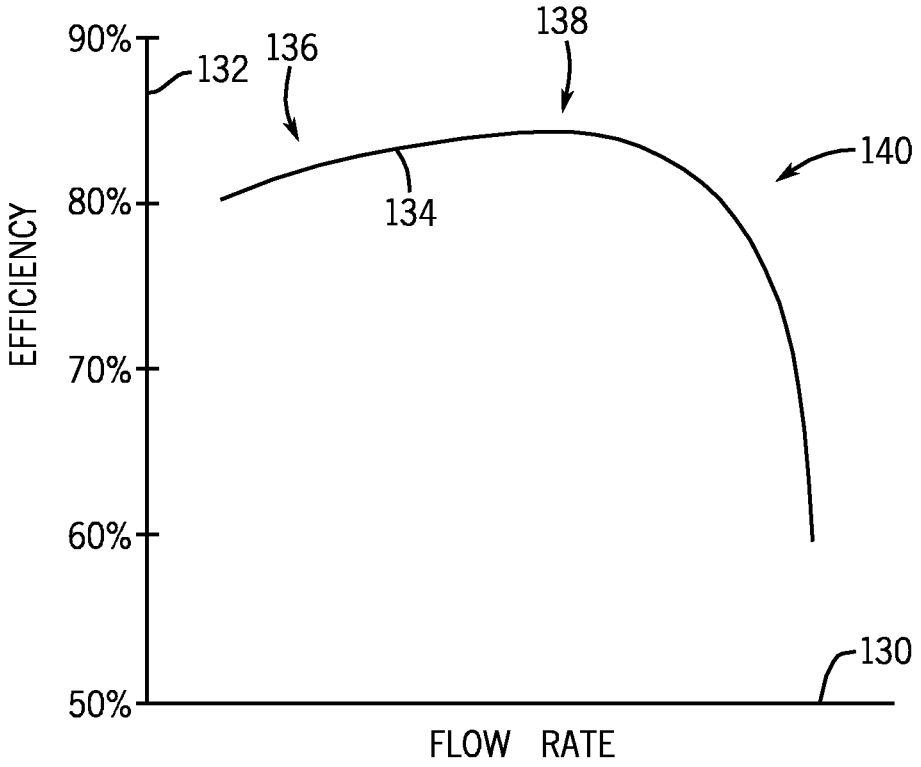
FIG. 8 is a graph of efficiency versus flow rate for a centrifugal compressor that may employ diffuser vanes, as shown in FIG. 1, in accordance with certain embodiments of the present technique.

FIG. 8 is a graph of efficiency versus flow rate for a centrifugal compressor 10 that may employ an embodiment of the diffuser vanes 18. As illustrated, a horizontal axis 130 represents flow rate through the centrifugal compressor 10, a vertical axis 132 represents efficiency (e.g., isentropic efficiency), and a curve 134 represents the efficiency of the centrifugal compressor 10 as a function of flow rate. The curve 134 includes a region of surge flow 136, a region of efficient operation 138, and a region of choked flow 140. As will be appreciated, the region 138 represents the normal operating range of the compressor 10. When flow rate decreases below the efficient range, the compressor 10 enters the surge flow region 136 in which insufficient fluid flow over the diffuser vanes 18 causes a stalled flow within the compressor 10, thereby decreasing compressor efficiency. Conversely, when an excessive flow of fluid passes through the diffuser 16, the diffuser 16 chokes, thereby limiting the quantity of fluid that may pass through the vanes 18.

As will be appreciated, configuring vanes 18 for efficient operation includes both increasing efficiency within the efficient operating region 138 and decreasing losses within the surge flow region 136 and the choked flow region 140. As previously discussed, three-dimensional airfoil-type vanes provide high efficiency within the efficient operating region, but decreased performance within the surge and choked flow regions. Conversely, two-dimensional cascade-type diffusers provide decreased losses within the surge flow and choked flow regions, but have reduced efficiency within the efficient operating region. The present embodiment, by contouring each vane 18 to match the flow properties of the impeller 12 and including a constant thickness section 64, may provide increased efficiency within the efficient operating region 138 and decreased losses with the surge flow and choked flow regions 136 and 140. For example, in certain embodiments, the present vane configuration may provide substantially equivalent surge flow and choked flow performance as a two-dimensional cascade-type diffuser, while increasing efficiency within the efficient operating region by approximately 1.5%.

While the invention may be susceptible to various modifications and alternative forms, specific embodiments have been shown by way of example in the drawings and have been described in detail herein. However, it should be understood that the invention is not intended to be limited to the particular forms disclosed. Rather, the invention is to cover all modifications, equivalents, and alternatives falling within the spirit and scope of the invention as defined by the following appended claims.

The invention claimed is:

1. A system comprising:

a centrifugal compressor diffuser vane, comprising:

a leading edge disposed between pressure and suction surfaces and extending along a span of the centrifugal compressor diffuser vane in a span direction from a vane root to a vane tip;

a trailing edge disposed between the pressure and suction surfaces and extending along the span of the centrifugal compressor diffuser vane in the span direction from the vane root to the vane tip; and a constant thickness section disposed between the pressure and suction surfaces and extending along a camber line between the leading edge and the trailing edge, wherein a ratio of a length of the constant thickness section to a chord length of the centrifugal compressor diffuser vane is at least approximately 50%, wherein the ratio is constant in the span direction along the span of the centrifugal compressor diffuser vane, wherein the chord length varies in the span direction along the span of the centrifugal compressor diffuser vane, wherein the centrifugal compressor diffuser vane comprises at least one of:

a curvature extending in the span direction along at least one of the leading edge or the trailing edge; or the leading and trailing edges gradually extending in a common direction along the camber line as the centrifugal compressor diffuser vane extends in the span direction from the vane root to the vane tip; or a length along the camber line of at least one of the constant thickness section, a tapered leading edge section, or a tapered trailing edge section, varying in the span direction; or the tapered leading and trailing edge sections each converging from the pressure and suction surfaces toward the camber line; or a curved profile at a tip of at least one of the leading edge or the trailing edge, wherein the curved profile has a radius of curvature that varies in the span direction; or any combination thereof.

2. The system of claim 1, wherein a camber angle of the centrifugal compressor diffuser vane varies in the span direction along the span of the centrifugal compressor diffuser vane.

3. The system of claim 1, wherein a first radius of curvature of the leading edge is selected to reduce an incidence angle between a fluid flow and the leading edge compressor diffuser vane.

4. The system of claim 1, wherein a circumferential position of the leading edge, a circumferential position of the trailing edge, or a combination thereof, varies in the span direction along the span of the centrifugal compressor diffuser vane.

5. The system of claim 1, wherein a radial position of the leading edge, a radial position of the trailing edge, or a combination thereof, varies in the span direction along the span of the centrifugal compressor diffuser vane.

6. The system of claim 1, comprising a centrifugal compressor diffuser including a plurality of centrifugal compressor diffuser vanes disposed about a hub and/or an impeller in an annual arrangement.

7. The system of claim 6, wherein a circumferential spacing between each pair of adjacent vanes of the plurality of centrifugal compressor diffuser vanes is equal.

8. The system of claim 6, wherein a circumferential spacing between the plurality of centrifugal compressor diffuser vanes is uneven.

9. The system of claim 6, wherein a distance between the leading edge and the impeller varies in the span direction along the span of each vane of the plurality of centrifugal compressor diffuser vanes.

10. The system of claim 6, wherein a distance between the trailing edge and the impeller varies in the span direction along the span of each vane of the plurality of centrifugal compressor diffuser vanes.

11. The system of claim 6, wherein each vane of the plurality of centrifugal compressor diffuser vanes is angled approximately between 10 to 30 degrees relative to a circumferential axis of the hub.

12. The system of claim 1, wherein the centrifugal compressor diffuser vane has the leading and trailing edges gradually extending in the common direction along the camber line as the centrifugal compressor diffuser vane extends in the span direction from the vane root to the vane tip.

13. The system of claim 1, wherein the centrifugal compressor diffuser vane has the length along the camber line of at least one of the constant thickness section, the tapered leading edge section, or the tapered trailing edge section, varying in the span direction.

14. The system of claim 1, wherein the centrifugal compressor diffuser vane has the tapered leading and trailing edge sections each converging from the pressure and suction surfaces toward the camber line.

15. The system of claim 1, wherein the centrifugal compressor diffuser vane has two or more of:

the curvature extending in the span direction along at least one of the leading edge or the trailing edge; or the leading and trailing edges gradually extending in the common direction along the camber line as the centrifugal compressor diffuser vane extends in the span direction from the vane root to the vane tip; or the length along the camber line of at least one of the constant thickness section, the tapered leading edge section, or the tapered trailing edge section, varying in the span direction; or the tapered leading and trailing edge sections each converging from the pressure and suction surfaces toward the camber line; or the curved profile at the tip of at least one of the leading edge or the trailing edge, wherein the curved profile has the radius of curvature that varies in the span direction.

16. A system comprising:

a centrifugal compressor diffuser vane, comprising:

a leading edge disposed between pressure and suction surfaces and extending along a span of the centrifugal compressor diffuser vane in a span direction from a vane root to a vane tip;

a trailing edge disposed between the pressure and suction surfaces and extending along the span of the centrifugal compressor diffuser vane in the span direction from the vane root to the vane tip;

a constant thickness section disposed between the pressure and suction surfaces and extending along a camber line between the leading edge and the trailing edge, wherein a ratio of a length of the constant thickness section to a chord length of the centrifugal compressor diffuser vane is at least approximately 50%, wherein the centrifugal compressor diffuser vane comprises at least one of:

a curvature extending in the span direction along at least one of the leading edge or the trailing edge; or the leading and trailing edges gradually extending in a common direction along the camber line as the centrifugal compressor diffuser vane extends in the span direction from the vane root to the vane tip; or a length along the camber line of at least one of the constant thickness section, a tapered leading edge section, or a tapered trailing edge section, varying in the span direction; or the tapered leading and trailing edge sections each converging from the pressure and suction surfaces toward the camber line; or a curved profile at a tip of at least one of the leading edge or the trailing edge, wherein the curved profile has a radius of curvature that varies in the span direction; or any combination thereof;

wherein a camber angle of the centrifugal compressor diffuser vane varies in the span direction along the span of the centrifugal compressor diffuser vane; and wherein a first radius of curvature of the leading edge, a second radius of curvature of the trailing edge, the camber angle, or a combination thereof, is selected based on a two-dimensional transformation of an axial flat plate to a radial flow configuration.

17. A system comprising:

a centrifugal compressor diffuser, comprising:

a hub; and a plurality of vanes extending from the hub in an axial direction, wherein each vane of the plurality of vanes includes a tapered leading edge section extending along a camber line, a tapered trailing edge section extending along the camber line, and a constant thickness section extending along the camber line between the tapered leading edge section and the tapered trailing edge section, wherein the constant thickness section has a first length along the camber line greater than approximately 50% of a vane chord length, and wherein a second length along the camber line of the tapered leading edge section, a third length along the camber line of the tapered trailing edge section, and the first length along the camber line of the constant thickness section vary in a span direction from a vane root to a vane tip along a span of each vane of the plurality of vanes.

18. The system of claim 17, wherein the plurality of vanes is disposed about the hub in an annual arrangement, and wherein a circumferential spacing between each pair of adjacent vanes of the plurality of vanes is equal.

19. The system of claim 17, wherein each vane of the plurality of vanes is angled approximately between 10 to 30 degrees relative to a circumferential axis of the hub.

20. The system of claim 17, wherein a camber angle of each vane of the plurality of vanes varies in the span direction from the vane root to the vane tip along the span of each vane of the plurality of vanes.

21. The system of claim 20, wherein the second length along the camber line of the tapered leading edge section, the third length along the camber line of the tapered trailing edge section, the camber angle, or a combination thereof, is selected based on a two-dimensional transformation of an axial flat plate to a radial flow configuration.

22. The system of claim 17, wherein a ratio of the first length along the camber line of the constant thickness section to the vane chord length is constant along the span of each vane of the plurality of vanes.

23. A system comprising:

a centrifugal compressor, comprising:

an impeller; and a diffuser disposed about the impeller, wherein the diffuser comprises a plurality of vanes, each vane of the plurality of vanes comprises a leading edge, a trailing edge, and a constant thickness intermediate section extending along a camber line between the leading edge and the trailing edge, wherein a ratio of a length of the constant thickness intermediate section to a chord length of the centrifugal compressor diffuser vane is at least approximately 50%, wherein the ratio is constant in the span direction along the span of the centrifugal compressor diffuser vane, wherein the chord length varies in the span direction along the span of the centrifugal compressor diffuser vane, wherein each vane of the plurality of vanes comprises a curvature extending in a span direction from a vane root to a vane tip of the vane along at least one of the leading edge or the trailing edge.

24. The system of claim 23, wherein each vane of the plurality of vanes comprises the leading and trailing edges gradually extending in a common direction along the camber line as the vane extends in the span direction from the vane root to the vane tip.

25. The system of claim 23, wherein each vane of the plurality of vanes comprises a length along the camber line of at least one of the constant thickness intermediate section, the tapered leading edge section, or the tapered trailing edge section, varying in the span direction.

26. The system of claim 23, wherein each vane of the plurality of vanes comprises tapered leading and trailing edge sections each converging from the pressure and suction surfaces of the vane toward the camber line.

27. A system comprising:

a centrifugal compressor, comprising:

an impeller; and a diffuser disposed about the impeller, wherein the diffuser comprises a plurality of vanes, each vane of the plurality of vanes comprises a leading edge, a trailing edge, and a constant thickness intermediate section extending along a camber line between the leading edge and the trailing edge, wherein a ratio of a length of the constant thickness intermediate section to a chord length of the centrifugal compressor diffuser vane is at least approximately 50%, wherein the ratio is constant in the span direction along the span of the centrifugal compressor diffuser vane, wherein the chord length varies in the span direction along the span of the centrifugal compressor diffuser vane, wherein each vane of the plurality of vanes comprises a curved profile at a tip of at least one of the leading edge or the trailing edge, wherein the curved profile has a radius of curvature that varies in the span direction from the vane root to the vane tip.

28. A system comprising:

a centrifugal compressor diffuser vane, comprising:

a leading edge disposed between pressure and suction surfaces and extending along a span of the centrifugal compressor diffuser vane in a span direction from a vane root to a vane tip;

a trailing edge disposed between the pressure and suction surfaces and extending along the span of the centrifugal compressor diffuser vane in the span direction from the vane root to the vane tip; and a constant thickness section disposed between the pressure and suction surfaces and extending along a camber line between the leading edge and the trailing edge, wherein a ratio of a length of the constant thickness section to a chord length of the centrifugal compressor diffuser vane is at least approximately 50%, wherein the ratio is constant in the span direction along the span of the centrifugal compressor diffuser vane, wherein the chord length varies in the span direction along the span of the centrifugal compressor diffuser vane, wherein the centrifugal compressor diffuser vane has a curvature extending in the span direction along at least one of the leading edge or the trailing edge.

29. A system comprising:

a centrifugal compressor diffuser vane, comprising:

a leading edge disposed between pressure and suction surfaces and extending along a span of the centrifugal compressor diffuser vane in a span direction from a vane root to a vane tip;

a trailing edge disposed between the pressure and suction surfaces and extending along the span of the centrifugal compressor diffuser vane in the span direction from the vane root to the vane tip; and a constant thickness section disposed between the pressure and suction surfaces and extending along a camber line between the leading edge and the trailing edge, wherein a ratio of a length of the constant thickness section to a chord length of the centrifugal compressor diffuser vane is at least approximately 50%, wherein the ratio is constant in the span direction along the span of the centrifugal compressor diffuser vane, wherein the chord length varies in the span direction along the span of the centrifugal compressor diffuser vane, wherein the centrifugal compressor diffuser vane has a curved profile at a tip of at least one of the leading edge or the trailing edge, wherein the curved profile has a radius of curvature that varies in the span direction.

* * * * *